US007290423B2

(12) United States Patent
Carsley et al.

(10) Patent No.: US 7,290,423 B2
(45) Date of Patent: Nov. 6, 2007

(54) ROLLER HEMMING APPARATUS AND METHOD

(75) Inventors: John E. Carsley, Clinton Township, MI (US); Wayne W. Cai, Troy, MI (US); Gary A. Kruger, Troy, MI (US); Paul E. Krajewski, Sterling Heights, MI (US); Yang-Tse Cheng, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 275 days.

(21) Appl. No.: 11/093,383

(22) Filed: Mar. 30, 2005

(65) Prior Publication Data

US 2005/0284204 A1 Dec. 29, 2005

Related U.S. Application Data

(60) Provisional application No. 60/562,811, filed on Apr. 15, 2004.

(51) Int. Cl.
*B21D 7/02* (2006.01)

(52) U.S. Cl. ..... 72/214; 72/128

(58) Field of Classification Search ..... 72/210, 72/214, 215, 220, 128; 29/243.58
See application file for complete search history.

(56) References Cited

U.S. PATENT DOCUMENTS 3,834,199 A * 9/1974 Rouyer et al. ..... 72/38
5,948,185 A * 9/1999 Krajewski et al. ..... 148/698
6,477,879 B1 * 11/2002 Sawa ..... 72/220
6,672,121 B2 1/2004 Carsley et al. ..... 72/57

* cited by examiner

*Primary Examiner*—Derris H. Banks
*Assistant Examiner*—Debra Wolfe

(57) ABSTRACT

Various embodiments of roller hemming apparatus and methods are disclosed including one wherein multiple rollers are carried on a single mount to hem a flange in a single pass, another including induction heating and air quenching means movable with a roller to anneal the flange just prior to hem forming, and another in which friction from a rotatably driven roller heats the flange to reduce bending stresses during hemming of the flange.

4 Claims, 6 Drawing Sheets

ROLLER HEMMING APPARATUS AND METHOD

CROSS-REFERENCE TO RELATED APPLICATIONS

This application claims priority from U.S. Provisional Patent Application No. 60/562,811 filed Apr. 15, 2004.

TECHNICAL FIELD

This invention relates to hemming the edges of inner and outer body panels to form an assembly having closed edges. More particularly, the invention relates to improved roller hemming apparatus and methods.

BACKGROUND OF THE INVENTION

Roller hemming is a relatively recent development for joining inner and outer body panels by folding the outer flange over the edge of the inner panel. This process can create a sharp hem appearance comparable to conventional hemmers for typical steel sheet panels. However, when hemming aluminum panels, conventional hemmers must be modified to reduce the bending severity of the aluminum sheet in order to prevent cracking along the hemline. Sharp, flat hems are very difficult to produce in aluminum panels with conventional hemmers.

A roller hemming apparatus deforms the flange through a non-plane strain deformation path which enables more severe bending in aluminum sheet to possibly form a flat hem, similar to steel panels. In either material, the cycle time for roller hemming is generally much longer than with conventional hemming because the roller must bend the flange in two to three passes around the periphery of the panel. The initial pass bends the flange to the prehem position (approximately 45 degrees), while the final pass flattens the hem.

Even with this advantage, age-hardenable aluminum alloys, such as AA6111 commonly used for outer panels, have very limited bendability, especially when material at the hemline is pre-strained during the stamping operation. The retrogression heat treatment (RHT) process of U.S. Pat. No. 5,948,185 has been used in production of aluminum panel assemblies to improve hemming and prevent cracking with conventional hemmers.

The RHT process applies a local heat treatment and immediate quench to the flange area that temporarily softens the material by dissolving unstable particles in the microstructure. This provides sufficient bendability to flat hem age-hardenable aluminum panels. A disadvantage of RHT is inserting the heat treatment operation in the production flow between the flanging press and the marriage station. The heat treatment is performed in a separate operation, which adds a process step that increases the size of the assembly cell and increases manufacturing cost.

Current roller hemming methods use a solid, free rolling tool on the end of a robotic mount section to deform a sheet metal flange to a flat hem condition by rolling around the perimeter of a panel in a series of passes. These methods bend the flange from 90-degrees open to completely closed and flat by deforming the sheet metal through a non-plane strain bending path.

Conventional hemmers bend the flange through "plane strain bending," which is the most severe strain path and often leads to cracking at the hemline of aluminum panels. With the alternate strain path bending, roller hemming is capable of flat hemming aluminum panels without splitting. However, tight radius bending with the roller to achieve a desirable sharp, crisp, appearance may not be possible for aluminum alloys without specially treating the material, as in the case of RHT (retrogression heat treatment), which locally and temporarily softens the material in the bend region.

SUMMARY OF THE INVENTION

The present invention includes various embodiments of roller hemming apparatus and methods which are adapted for reducing hemming cycle time and/or improving hem quality of sheet metal panel assemblies and, in some cases for assemblies formed with aluminum alloy panels.

In initial embodiments, the invention combines two or more sequential rollers in a roller apparatus. One roller prehems the initial flange from a 90 degrees open position to approximately 45 degrees open, while the second roller flattens the hem to the closed position. The shape of the rollers can be cylindrical, conical or machined with other shape details as needed for any particular product.

With these multiple rollers, the flange can be rolled from the 90 degree upstanding position to the complete hem condition in ONE pass of the rollers around the periphery of the panel. This has significant implications for cycle time.

In an alternative embodiment, the present invention incorporates a heating device, such as an induction coil, fixed to a roller apparatus, in advance of a hemming roller. Other heating devices, such as flame or laser, might also be used. As a robot or other device drives the roller apparatus along the flange of the outer panel, the heating device applies a retrogression heat treatment (RHT) to the hem line material just prior to contact with the roller which bends the flange. An air "knife" is positioned between the induction coil and the roller to rapidly quench the material with the softened microstructure.

In addition to the hemming of aluminum, the invention could be used to enhance the hemmability of other sheet metals, such as steel, high-strength steel, magnesium alloys, etc. The hemming device could be configured for hot roller hemming to further improve the bendability of these sheet metals.

Another variation of the present invention provides a method to roller hem sheet metal to a very tight, sharp radius at the hemline without cracking, by incorporating some of the microstructural effects of the RHT heat treatment. The invention provides an electric motor to spin the roller at a controlled speed to produce friction between the roller and the sheet metal flange during the roller hemming process. This friction will create heat in the sheet metal that will locally soften the material and improve bendability to enable the sharp, crisp radius of the desired appearance.

The roller is positioned in such a way that the frictional contact area is at or near the bend area that needs to be heated and quenched. The roller may have a flared shoulder portion adapted to engage the bend portion to concentrate the heat there. Because the friction produced heating is localized, it can quickly dissipate by conduction. The rapid cooling process, together with the mechanical alloying effect from friction induced deformation near the surface, can produce a very fine microstructure in the material and improve the strength of materials after hemming.

While the mechanical alloying effect will not likely extend through the thickness of the sheet in the bend region, the "graded microstructure" may provide beneficial in-service performance. Rapid heating and quenching is necessary to retrogress AA6111 (dissolve unstable particles about 350° C. and quench the microstructure for improved room-temperature bending), while maintaining bake hardenable characteristics. The rapid heating can also improve the hemming/bending behavior of steel sheets as well as other materials. Depending on the frictional heat transfer behavior, this technique could also be used to 'hot' bend magnesium sheet alloys and be used in other roll forming operations for shaping sheet alloys of aluminum, steel, magnesium, copper, etc. The rapid heating/quenching to refine the microstructure in the solid state may be related to the friction-stir welding phenomena. This technology may have a significant influence on the bending and hemming of magnesium sheet panels that that have limited ductility. This friction technique will focus the heating effect on the local deformation region, sufficiently heating the magnesium to enable hemming without causing thermal distortions in the remainder of the product.

An additional benefit of frictional heating with roller hemming is improved quality with respect to flange wrinkling around "plan-view" radii such as the bottom corner of a deck lid which tends to occur as the roller bends the flange in the first pass. These wrinkles are "ironed-out" in the final pass, but the effect can be seen on the final product. Warm bending of the flange may inhibit this wrinkling behavior. Another benefit of frictional heating is that the dissipating heat will assist the curing of hem adhesives on the final pass that completes the flat hem.

These and other features and advantages of the invention will be more fully understood from the following description of certain specific embodiments of the invention taken together with the accompanying drawings.

DESCRIPTION OF EXEMPLARY EMBODIMENTS

Figure 1:
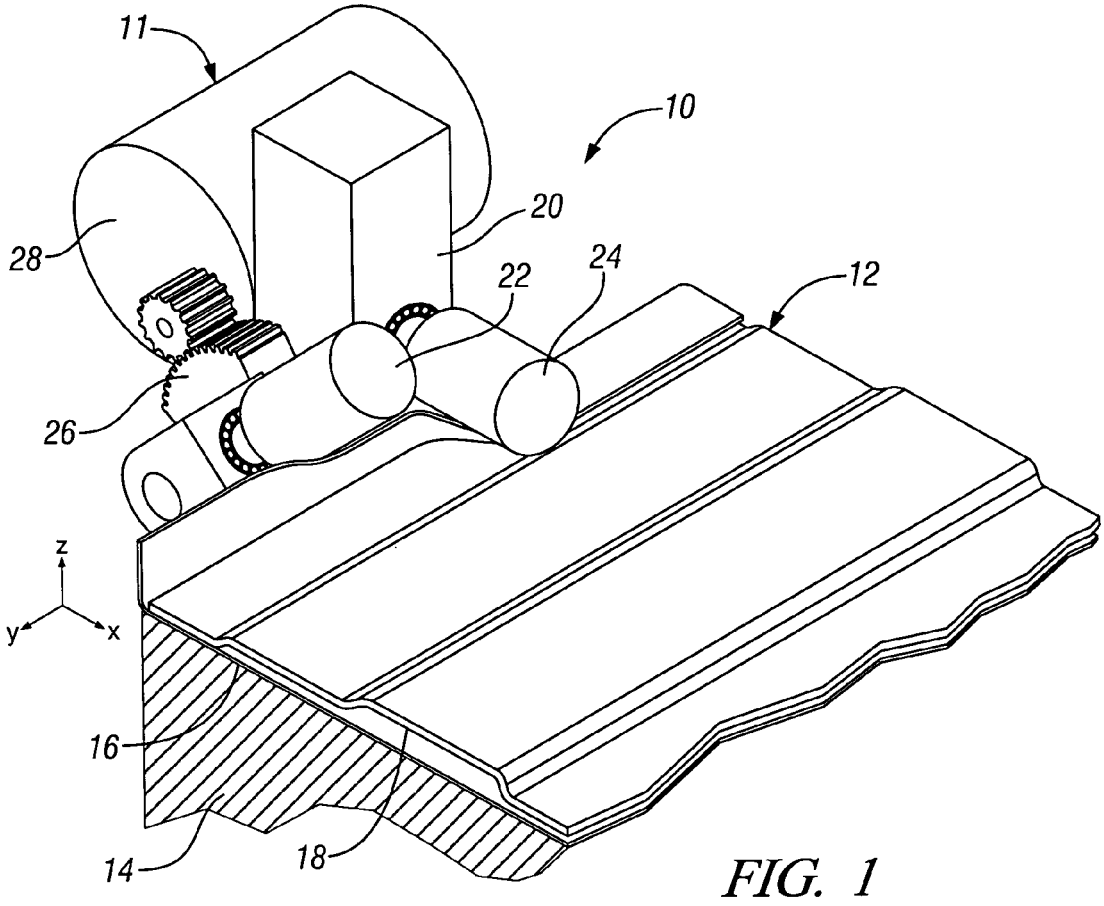
FIG. 1 is an isometric pictorial view showing, in operation, a first embodiment of roller hemming apparatus according to the present invention and indicating directions of x, y and z axes.
Figure 2:
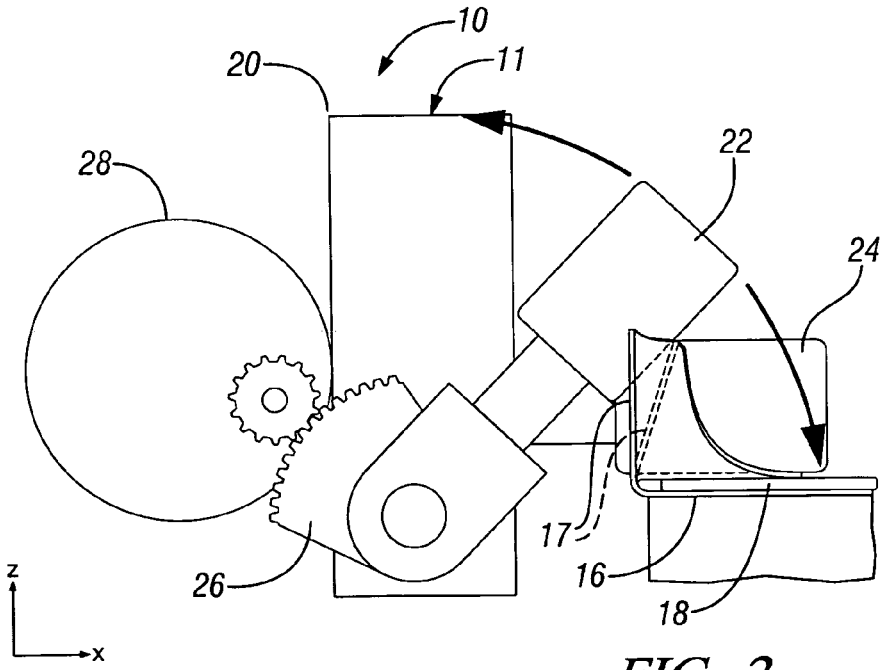
FIG. 2 is a left side view of the apparatus of FIG. 1 from the x-z plane.
Figure 3:
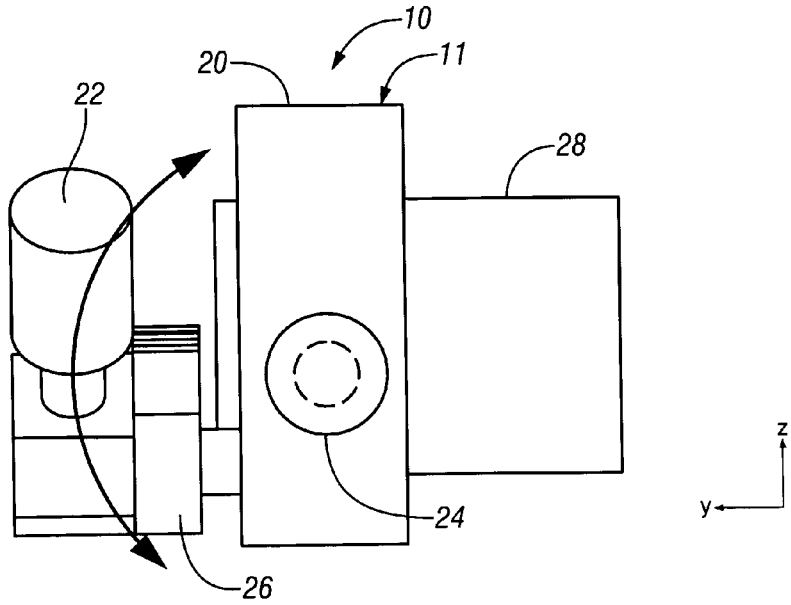
FIG. 3 is a front view of the apparatus from the y-z plane.

One example of the implementation of this invention is shown in FIGS. 1-3 of the drawings, wherein numeral 10 generally indicates a hemming station for panel hemming. In station 10, a robotic roller apparatus 11 is positioned adjacent a panel assembly 12, which is supported by rigid tooling or an anvil 14. The tooling or anvil would also be provided with a suitable retainer, such as a clamping device not shown, for holding the panel assembly 12 in position during the hemming operations.

The panel assembly includes an outer panel 16, with an end flange 17, and an inner panel 18 being hemmed together by the roller apparatus 11. The apparatus 11 includes a robotic mount section 20 carried by a robot, not shown, and contains a prehem (45 degree) roller 22 and a final roller 24. These rollers bend the flange 17 from a 90 degree angle to a 180 degree angle in two steps during a single pass of the roller apparatus.

The prehem (45 degree) roller 22 is flexible and programmable for rotation about the y-axis to achieve appropriate prehem bending. Rotation to position the angle of this roller 22 may be controlled by any suitable mechanism, one of which is represented by a gear 26 and an electric stepping motor 28 incorporated into the roller apparatus 11. This degree of freedom is necessary to ensure proper bending through all contours of the panel. To adjust the height of the prehem roller 22, the robot can rotate the roller apparatus 11 about the axis of the final hem roller 24 for a third degree of freedom.

The invention is further illustrated in FIGS. 2 and 3 with axial views along the bend axis of the hemline (y-axis) and along the rotational axis of the final roller 24 (x-axis). FIG. 2 shows the relative positions of the two rollers.

The rotational flexibility of the prehem roller 22, provided by a gear 26 and a stepping motor 28, would allow this embodiment to be operable in reverse. For example, the roller apparatus 11 could be rotated about the y-axis so that the roller 24 would act as the pre hem roller and the roller 22 could be used as the final roller.

This embodiment may also enable the forming of the very sharp, pinch shape described in U.S. Pat. No. 6,672,121, and could be used with all sheet metal alloys, including, but not limited to, heat treatable AA6111-T4, non-heat treatable AA5182, AA5754 & AA5083, and any steel sheet application.

In another application, this embodiment could be used to bend the initial flange from 180 degrees to 90 degrees followed by the flat hemming operation. Roller flanging would allow the elimination of the flange press operation leading to further cost reductions.

Further embodiments of the invention are provided which incorporate retrogression heat treatment for softening aluminum alloys for hemming. One example for implementing this concept is shown in FIGS. 4-10.

Figure 4:
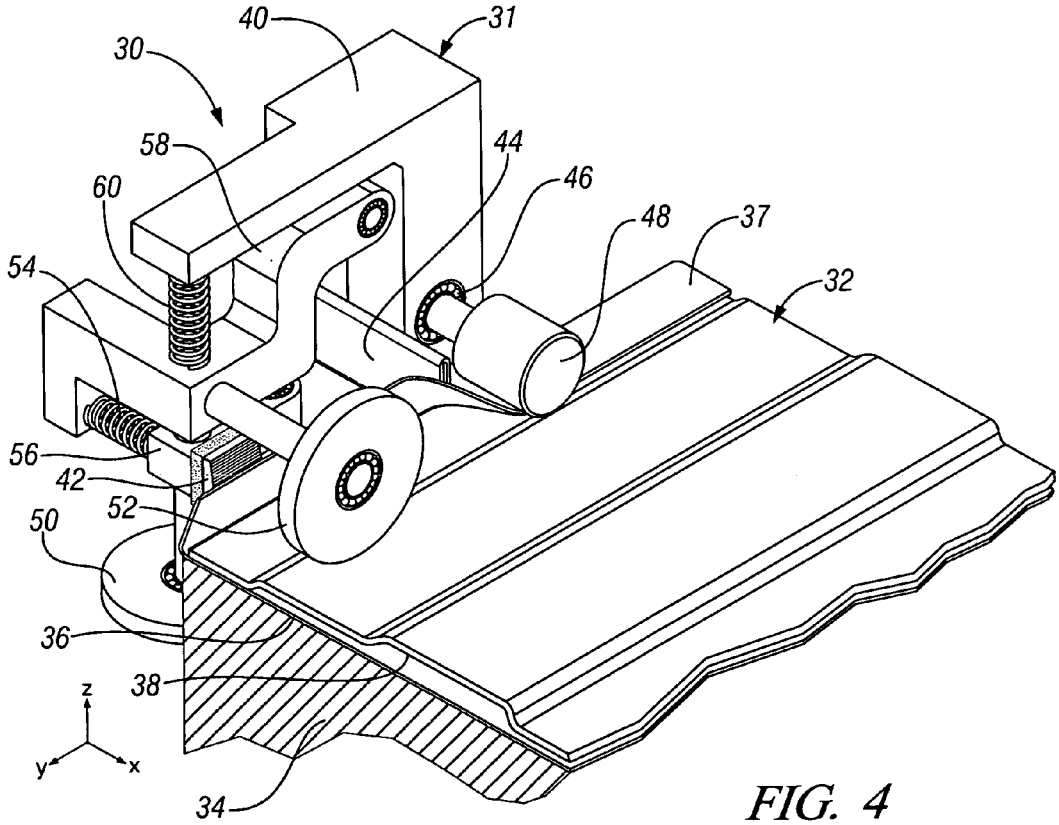
FIG. 4 is an isometric pictorial view showing, in operation, a hemming station with a combined heat treating and roller hemming apparatus according to the present invention and indicating directions of x, y and z axes.

As seen in FIG. 4, a roller hemming station 30 includes a robotic roller apparatus 31 positioned adjacent to a panel assembly 32, which is supported by rigid tooling or an anvil 34. The panel assembly 32 includes an outer panel 36, with a hem flange 37, and an inner panel 38 being hemmed together by the roller apparatus 31 folding the flange 37 against the inner panel 38. The robotic roller apparatus 31 is carried by a robot (not shown) through a mount section 40, and contains an induction coil 42, an air-quenching knife 44, and roller bearings 46, which support a hem roller 48.

Vertical (z-direction) and transverse (x-direction) positions of the induction coil 42, with respect to a bend axis of the hemline, are controlled by guide rollers, including a side roller 50 in the x-direction and a top roller 52 the z-direction. A first compression spring 54 acts between an x pivot arm 56 and a z pivot arm 58, supporting the x pivot arm. A second compression spring 60, supported by the end of arm tool mount 40, acts against the z pivot arm 58 to maintain appropriate proximity between the induction coil 42 and the hemline material to obtain the proper retrogression heat treatment.

This flexibility, with guide rollers, compression springs and pivot arms, is necessary to allow the coil to follow the product contour while the robot motion is programmed for optimal positioning of the rollers to flat-hem the flange. The induction coil 42 is powered and water-cooled with flexible connections (not shown) running through the components of the roller apparatus 31 and tool mount section 40, along the robot arm (not shown) to a power supply (not shown).

Figure 5:
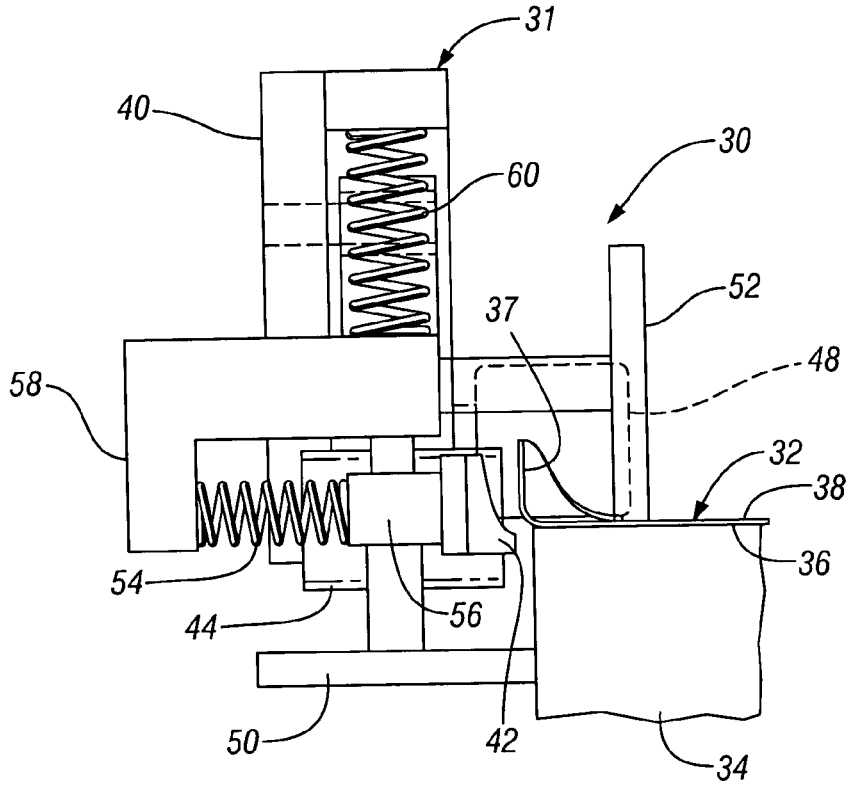
FIG. 5 is a left side view of the hemming station of FIG. 4 from the x-z plane along the bend axis of a hem flange.
Figure 6:
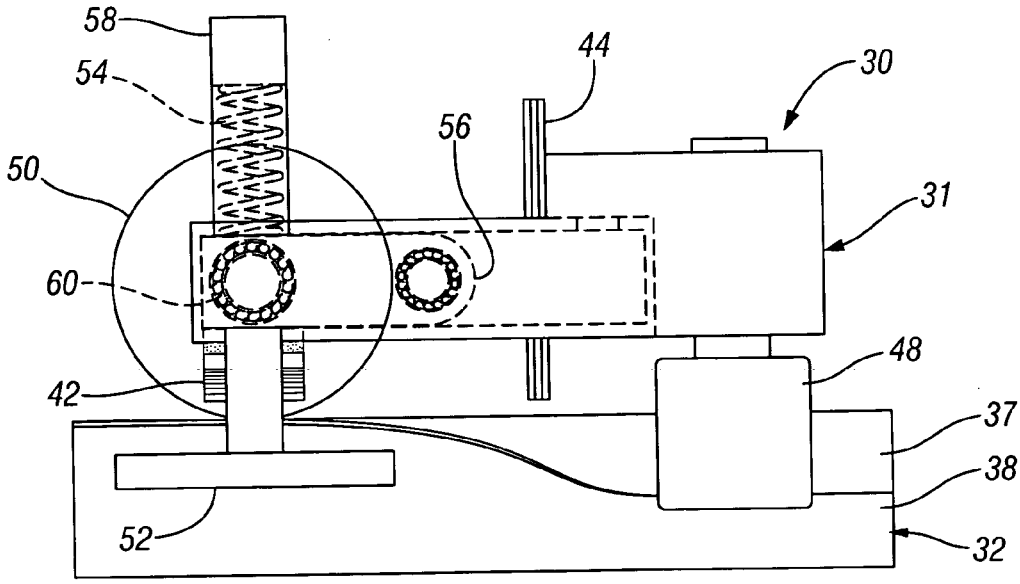
FIG. 6 is a plan view of the hemming station from the x-y plane.

The invention is further illustrated in FIGS. 5 through 10. FIG. 5 is a front axial view along the bend axis of the hemline and shows the relative positions of the guide rollers 50, 52 and the proximity of the induction coil 42 to the hem flange 37. FIG. 6 is a top view also showing the guide roller positions along with the hem roller 48.

Figure 7:
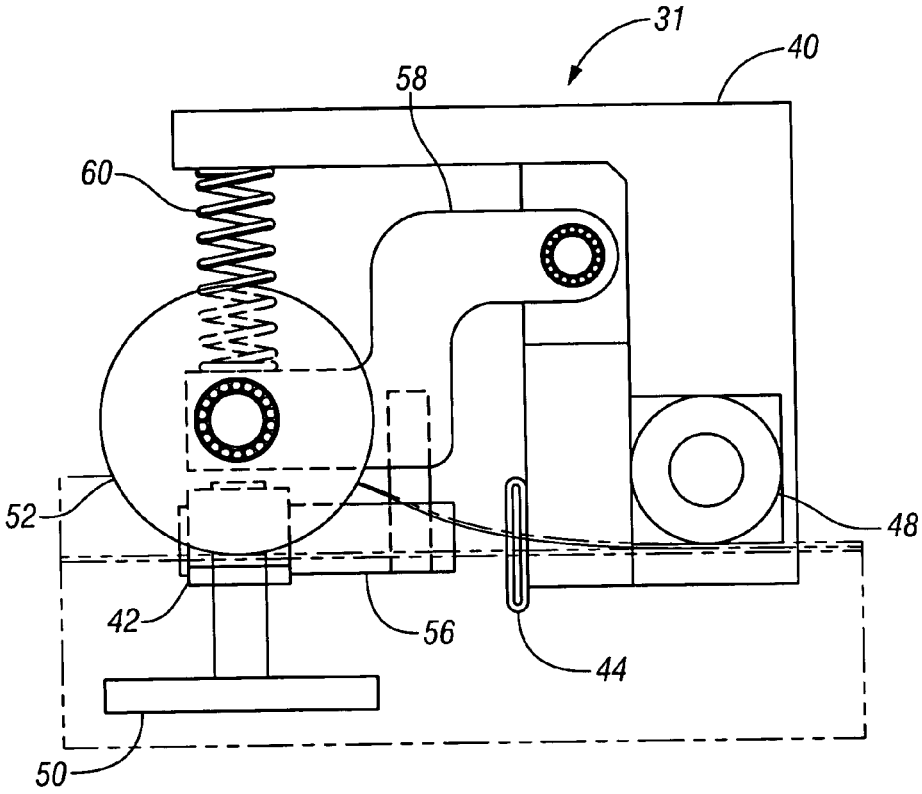
FIG. 7 is a front view of the apparatus of FIG. 4 from the y-z plane.
Figure 8:
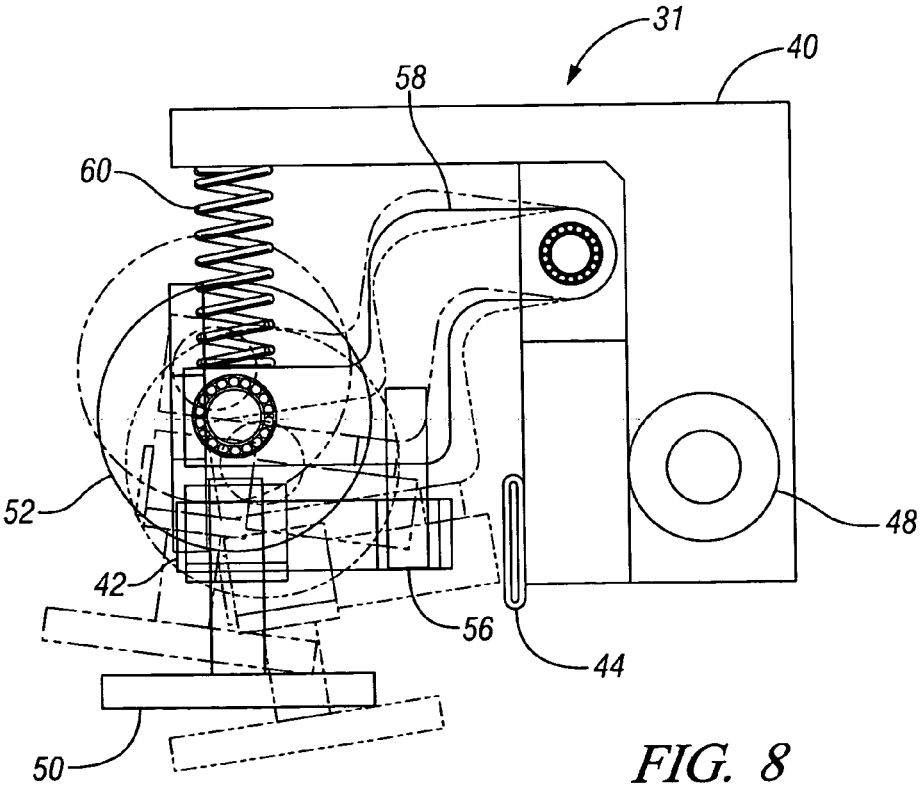
FIG. 8 is a front view similar to FIG. 4 showing motion of the guide rollers.
Figure 9:
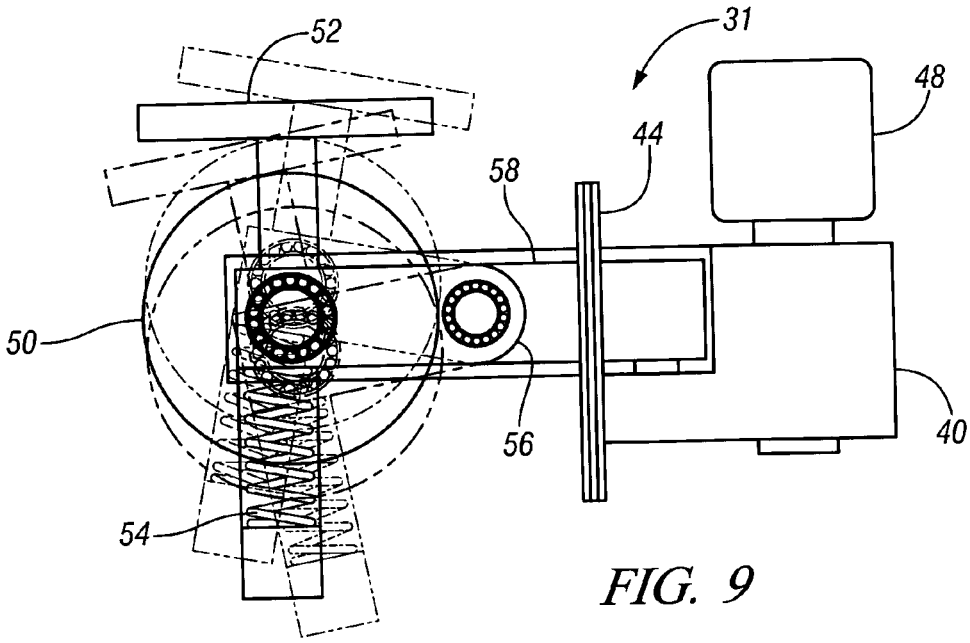
FIG. 9 is a bottom view of the apparatus from the x-y plane further showing motion of the guide rollers.
Figure 10:
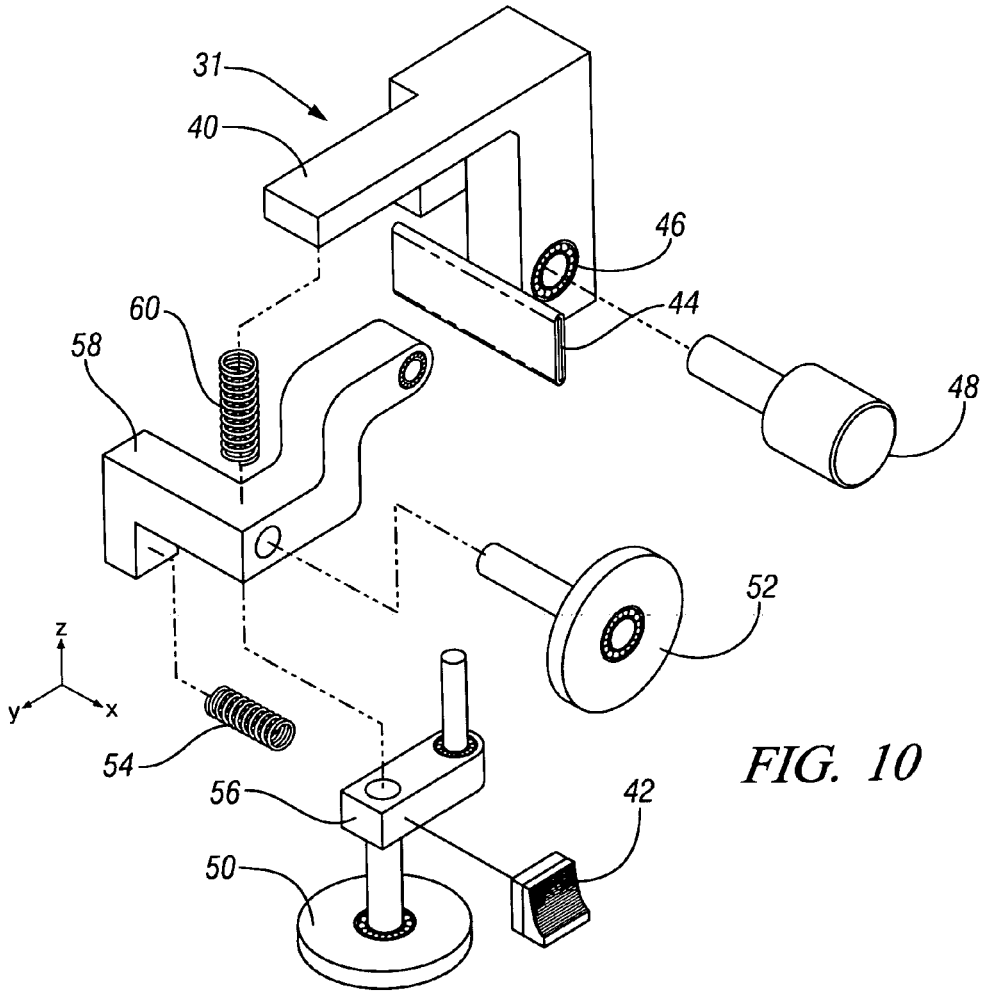
FIG. 10 is an isometric view similar to FIG. 1 but showing the roller apparatus as an exploded assembly.

FIG. 7 is the corresponding front view of all components of the roller apparatus 31. The flexibility of the guide rollers 50, 52 to maintain proper proximity for the induction coil to the hemline material is illustrated in the front view of FIG. 8 and the bottom view of FIG. 9. FIG. 10 shows the roller apparatus 31 in both assembled and exploded conditions.

The RHT process involves rapid heating to dissolve unstable particles and rapid quenching to maintain the resulting supersaturated solution condition that allows sufficient cold deformation for flat hemming. After heating, the solutionized material at the hemline will be quenched by the air knife and cold rolled to the flat hem condition.

In another use, this invention could be applied to the hemming of non-heat treatable aluminum alloys such as 5182, 5754 and 5083. The induction heating process would anneal the material in the hemline to remove the prior cold work, followed by the air quench and cold roller bending. This would enable severe bending during the roller hem process to achieve the sharp, pinch hem shape, and would be an application of a preforming annealing process for stamping aluminum sheet rather than the retrogression application, which applies to age-hardenable alloys.

In yet another embodiment of this invention, the induction coil could be used to heat the hemline material, which could then be "hot-hemmed" to create an extremely sharp outer bend radius that may provide a desirable appearance. Hot hemming would not likely apply to age-hardenable aluminum alloys, but rather would be applicable for 5xxx aluminum alloys, magnesium sheet alloys and steel sheet alloys.

With either hot or cold bending embodiments, this process may enable the forming of the very sharp, pinch hem shape described in U.S. Pat. No. 6,672,121. The pinch hem geometry, while possible with conventional hemmers, would most likely only be feasible with the roller hemming method.

Figure 11:
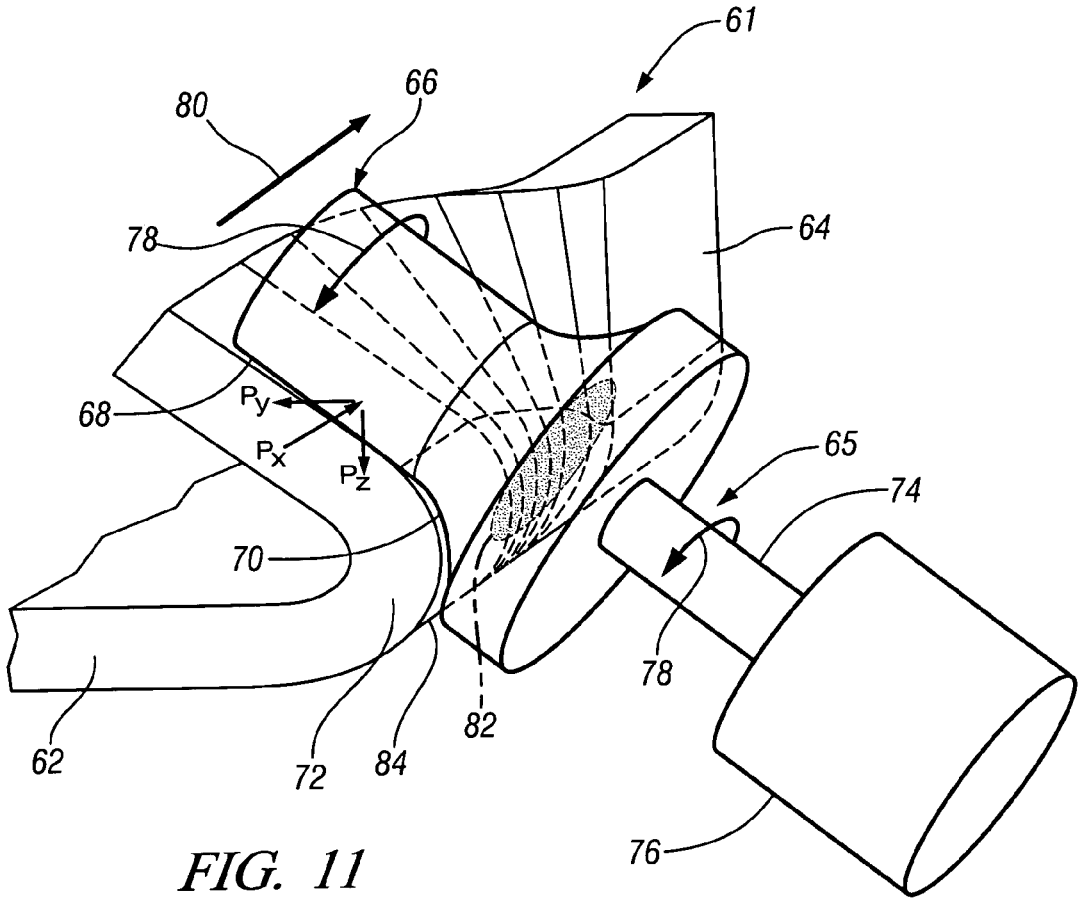
FIG. 11 is a schematic view of the structure and application of friction roller hemming according to the invention.

Still another embodiment of the invention involves a method called friction roller hemming. Referring to FIG. 11, numeral 61 indicates an apparatus and process for carrying out friction hemming of a sheet metal outer panel 62 with an inner panel, not shown. The outer panel 62 has a flange 64 angled initially in the 90-degree open position. A roller apparatus 65 including a solid roller 66 contacts the sheet metal flange 64 and is rotated to create heat from friction as it bends the flange in a closing direction. The roller 66 has a generally cylindrical end 68 and an inwardly adjacent flared shoulder portion 70 adapted to engage a bend portion 72 of the flange 64 to concentrate heating of the flange in the bend portion.

The roller 66 is carried on a shaft/axis 74 connected with an electric motor 76 mounted in a robotic mount section (not shown). The motor spins the roller 66 in the rotational direction of arrow 78 while the roller is moved in the lateral direction of arrow 80.

The lateral motion of the roller applies, against the sheet metal flange 64, a force vector having components $P_x$, $P_y$ and $P_z$, causing the flange to bend in a closing direction. Numeral 82 represents a line/area of contact between the roller and the flange upon which the force vector acts and in which friction heating occurs. The bend portion 72 of the hemline is deformed during the hemming process to produce a sharp, crisp bend radius 84 needed for the desired appearance.

Heat generated by friction between the roller 66 and the flange 64 locally softens the sheet metal in the bend portion 72, enhancing bending plasticity while resisting shear band localization and failure by cracking at the sharp, outer hem radius 84. The curved shape of the roller is designed to localize the frictional heat in the bend portion 72 during an initial pass (pre-hem step). The robot (not shown) repositions the roller 66 to flatten the hem on a final pass. This method can be used to produce the sharp, flat "pinch" hem geometry described in U.S. Pat. No. 6,672,121.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A method for roller hemming together edges of at least two metal panels to form an edge hemmed panel assembly, the method comprising:

positioning at least first and second metal panels with edges aligned in mated face engagement, the first panel having a flange portion bent from the mated edge of the first panel across and beyond the mated edge of the second panel;

providing hemming apparatus having a roller hemming portion operable in a process capable of completing a finished edge hem in at least one pass of relative motion along the length of the mated edge of the panels wherein the flange portion of the first panel is folded over in a gradual bend from one end to another of the mated edges to effectively engage the flange with an outer side of the mated edge portion of the second panel and thereby maintain the panels in an assembly;

wherein the hemming portion included a mount carrying annealing apparatus and at least a final roller positioned to serially operate on the flange portion as the mount is traversed along the length of the mated edges such that the annealing apparatus heats and quenches the flange prior to bending toward the second panel and the final roller finishes folding of the flange against the second panel to form the finished hem, the gradual folding of the flange being completed in at least one pass of the mount with the rollers moving from one end to an opposite end of the mated edges of the panels; and operating the apparatus according to said process to complete a finished hem of the mated edges of the panels;

wherein the annealing apparatus includes an induction coil and an air quenching knife positioned to carry out further method steps of sequentially induction heating and then air cooling the flange portion to relieve internal stresses in the flange portion prior to bending by the final roller; and wherein the apparatus includes pivoting arms supporting the induction coil, and guide rollers operative to maintain the induction coil in a desired position relative to the flange portion to provide a desired heating of the flange portion prior to the quenching step.

2. A method for roller hemming together edges of at least two metal panels to form an edge hemmed panel assembly, the method comprising:

positioning at least first and second metal panels with edges aligned in mated face engagement, the first panel having a flange portion bent from the mated edge of the first panel across and beyond the mated edge of the second panel;

providing hemming apparatus having a roller hemming portion operable in a process capable of completing a finished edge hem in at least one pass of relative motion along the length of the mated edges of the panels wherein the flange portion of the first panel is folded over in a gradual bend from one end to another of the mated edges to effectively engage the flange with an outer side of the mated edge portion of the second panel and thereby maintain the panels in an assembly;

wherein the hemming portion includes a mount carrying a motor driven roller, and the method further includes:

engaging the flange with the roller, including a curved portion of the bend, while rotatably driving the roller to heat the flange by friction sufficiently to enable sharper bending of the flange in a final pass without cracking; and traversing the roller along the length of the flange while continuing rotation of the roller to gradually fold over the flange from one end to another to form a flat hem while the temperature of the flange at the location of folding remains at a level of increased formability.

3. Roller hemming apparatus for attaching panel edges in face to face assembly by folding a flange portion adjacent an edge of one panel over a mated edge of another panel to form a hemmed panel assembly, the apparatus comprising:

a hemming portion having at least one roller capable of completing a finished edge hem along the length of the mated edges of the panels wherein the flange portion of the first panel is folded over in a gradual bend from one end to another end of the mated edges to effectively engage the flange with an outer side of the mated edge portion of the second panel and thereby maintain the panels in an assembly;

wherein the hemming portion includes a mount carrying annealing apparatus and at least a final roller positioned to serially operate on the flange portion as the mount is traversed along the length of the mated edge such that the annealing apparatus heat and quenches the flange and the final roller thereafter finishes folding of the flange against the second panel to form the finished hem, the gradual folding of the flange being completed with the roller moving from one end to an opposite end of the mated edges of the panels;

wherein the annealing apparatus includes an induction coil and an air quenching knife positioned to carry out method steps of sequentially induction heating and then cooling the flange portion to relieve internal stresses in the flange portion prior to bending by the final roller;

wherein the apparatus includes pivoting arms supporting the induction coil, and guide rollers operative to maintain the induction coil in a desired position relative to the flange portion to provide a desired heating of the flange portion prior to the quenching step.

4. Roller hemming apparatus for attaching panel edges in face to face assembly by folding a flange portion adjacent an edge of one panel over a mated edge of another panel to form a hemmed panel assembly, the apparatus comprising:

a hemming portion having at least one roller capable of completing a finished edge hem along the length of the mated edges of the panels wherein the flange portion of the first panel is folded over in a gradual bend from one end to another end of the mated edges to effectively engage the flange with an outer side of the mated edge portion of the second panel and thereby maintain the panels in an assembly;

wherein the hemming portion includes a motor connected to rotatably drive the roller to create friction heating and the roller is shaped with a flared shoulder portion adapted to engage the bend portion of the flange to concentrate heating of the flange in the bend portion during rolling of the flange.

* * * * *